US005376035A

United States Patent [19]

Forrest

[11] Patent Number: 5,376,035

[45] Date of Patent: Dec. 27, 1994

[54] POWER WINDING SELF-SETTING MARKER BODY

[76] Inventor: John W. Forrest, 2333 Walnut Court North, New Brighton, Minn. 55112

[21] Appl. No.: 954,284

[22] Filed: Sep. 30, 1992

[51] Int. Cl.[5] ..... B63B 22/18

[52] U.S. Cl. ..... 441/26; 242/390.8; 242/470

[58] Field of Search ..... 441/20–26, 441/28, 29, 6; 43/17.5, 43.1; 242/106, 96

[56] References Cited

U.S. PATENT DOCUMENTS

| | | | |
|---|---|---|---|
| 946,174 | 10/1910 | Vroman et al. | 441/26 |
| 1,287,580 | 12/1918 | Dumaine . | |
| 2,490,876 | 12/1949 | Lewis . | |
| 3,005,215 | 10/1961 | Colt | 9/8 |
| 3,653,085 | 4/1972 | Rouner | 441/23 |
| 3,822,839 | 7/1974 | Persichini | 242/96 |
| 3,827,093 | 8/1974 | Davis | 9/8 R |
| 4,074,380 | 2/1978 | Parker | 441/26 |
| 4,196,864 | 4/1980 | Cole | 242/106 |
| 4,405,303 | 9/1983 | Smith | 441/16 |
| 4,443,203 | 4/1984 | Maertens | 441/26 |
| 4,501,564 | 2/1985 | Cairone | 441/20 |
| 4,501,564 | 2/1985 | Johnson | 441/6 |
| 4,601,126 | 7/1986 | Klocksiem | 441/6 |
| 4,778,422 | 10/1988 | Saulneir | 441/26 |
| 4,781,636 | 11/1988 | Schurr | 441/6 |
| 4,856,219 | 8/1989 | Severance | 43/17.5 |
| 4,915,320 | 4/1990 | Neal | 242/96 |
| 5,067,920 | 11/1991 | Brisky | 441/25 |
| 5,087,216 | 2/1992 | Noggle | 441/26 |
| 5,234,365 | 8/1993 | Cooper et al. | 441/26 |

OTHER PUBLICATIONS

Cabella's Catalogue, Spring, 1993, p. No. 101 showing the commercial embodiment of the Rovner invention, above, or what is believed to be the Rovner invention.

*Primary Examiner*—Jesus D. Sotelo
*Attorney, Agent, or Firm*—Larry M. Jennings

[57] ABSTRACT

The invention discloses a highly visible marker buoy of the self-setting type the anchor line of which may be power wound to facilitate retrieval of the buoy after use; the marker buoy is equipped with spin indicators to prove that the anchor line is descending to the bottom of a body of water; fluorescent and phosphorescent materials are provided to increase both daytime and nighttime visibility.

6 Claims, 2 Drawing Sheets

POWER WINDING SELF-SETTING MARKER BODY

BACKGROUND OF THE INVENTION

1. Field of the Invention

This invention relates to buoyant, anchored markers for visually indicating a location on a body of water including, without limitation, fishing spots, water lanes, underwater structures, channels, and the like.

2. Description of the Prior Art

Buoyant markers are widely used in outdoor waters to indicate locations having certain features of interest such as the location of navigation channels, the location of fishes, and the presence of submerged structure. The present invention overcomes the limitations of the marker buoys presently known in the art. The present invention incorporates a power-winding feature which is not found in prior marker buoys in general use. It further incorporates highly visible fluorescent and phosphorescent materials to improve both daytime and nighttime visibility. Furthermore, the present invention causes a visible indication that the anchor line is being paid out from the anchor line reel portion of the buoy.

Simple, effective, self-setting marker buoys have been developed which will pay out anchor line of a length suitable to permit the buoy anchor to reach the bottom of the body of water and hold the buoy in a location nearly vertically above the anchor location. Such self-setting marker buoys generally rely on the weight of the anchor to cause the anchor line to pay out from a rotating body until the anchor reaches the bottom at which time a biasing weight limits further rotation of the body and pay out of anchor line.

One limitation on the use of self-setting marker buoys has been the difficulty in recovering them. Those having a small size or of the type disclosed by Rovner in U.S. Pat. No. 3,653,085 require many turns of the anchor line about the reel in order to rewind the anchor line and restore the device to a ready-to-use condition. The person who recovers the buoy may require an extended period of time to rewind all of the anchor line which has been extended from the marker. Not only is rewinding the anchor line tedious, it can be very unpleasant in cold weather.

A second limitation of the conventionally available marker buoys is that the anchor line will occasionally tangle and prevent the anchor from descending. When the anchor does not descend to the bottom, the marker can drift away from the desired location. The result can be the loss of the marker and the loss of a fishing location which has been identified as favorable.

A third limitation of the conventionally available marker buoys is that the surface coloration is seldom highly visible. That limitation can result in loss of the buoy or in limiting the useful range of the marker, especially when employed by users of small watercraft.

A fourth limitation of those buoys currently available in the marketplace is that they are difficult to see at night and during periods of low light. Lighted buoys are known but they are seldom completely reliable and generally require the use of batteries which are expensive and create a disposal problem.

A fifth limitation of those buoys previously available is that they may present durability problems. Marker buoys which are of flattened or rectangular solid shapes may be awkward to use or store and those having long projections may be prone to breakage. For example, the U.S. Pat. No 4,405,303 to Smith discloses sizeable projections which appear likely prone to breakage.

SUMMARY OF THE INVENTION

The present invention is a power wound self-setting marker buoy having visible spin indicators to prove that the anchor is descending, fluorescent coloring for improved daytime visibility, and phosphorescent materials for improved nighttime visibility. The paid-out anchor line may be conveniently re-wound by engaging, by means of a conventional socket or otherwise, an external source of rotatory motive power such as a cordless electric screwdriver.

DETAILED DESCRIPTION OF THE PREFERRED EMBODIMENT(S)

Figure 1:
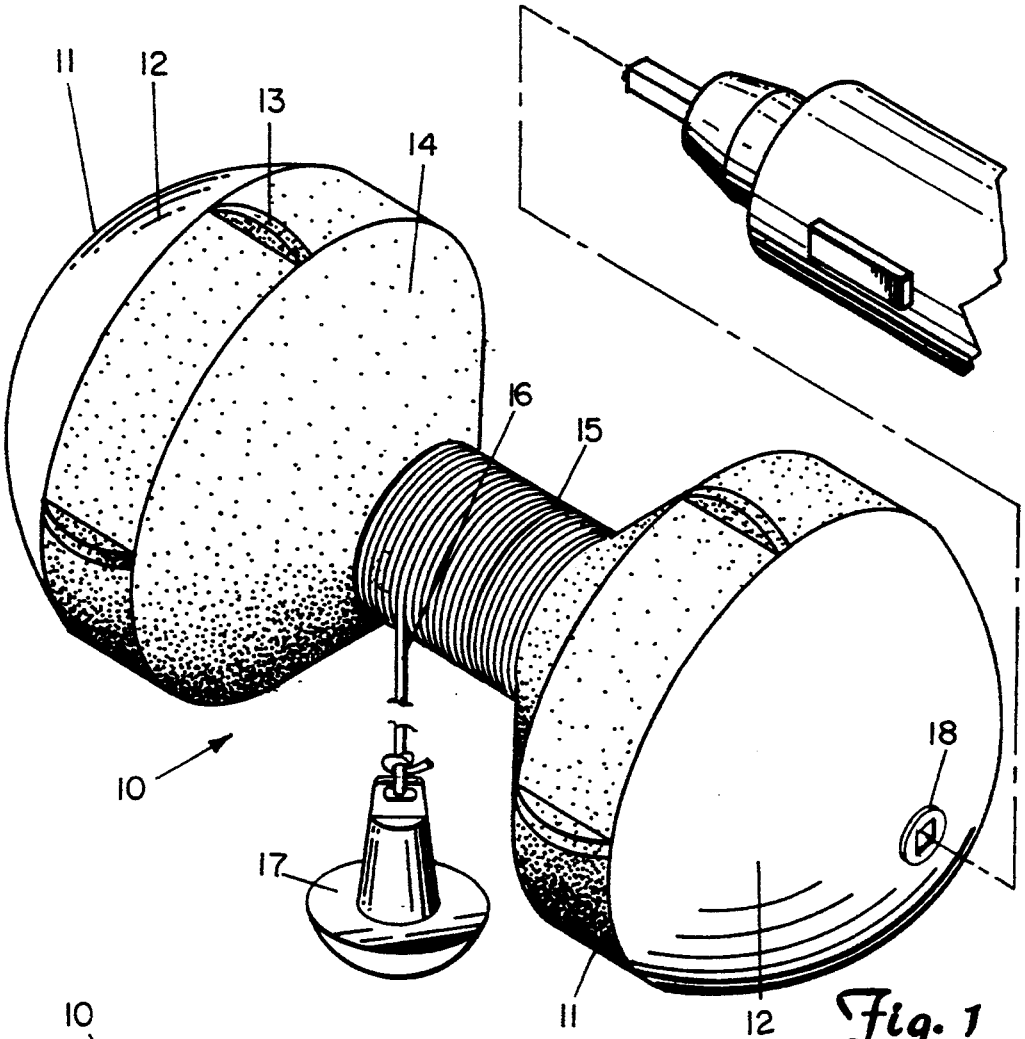
FIG. 1. is a perspective view of the power wound marker buoy apparatus according to the invention.

Referring to the drawings in detail wherein like numerals designate like parts, and with particular reference to FIG. 1, a power winding, self-setting marker buoy (10) embodying the invention comprises, an elongated middle portion (15) to each end of which is connected an end portion (11) enlarged with respect to the middle portion. In the preferred embodiment, the middle portion is cylindrical and solid although it is possible for the invention to function if the middle portion is hollow or has a non-cylindrical shape; the enlarged end portions are somewhat spherical and are partially comprised of phosphorescent materials (12) and partially comprised of fluorescent materials (14). It is to be understood that the shape of the marker buoy body and relative arrangement and amounts of the respective pigments, colorants, and visibility enhancing materials may be altered to suit specific applications without limiting the invention.

When the marker buoy is placed upon the water surface, the anchor (17) sinks toward the bottom of a body of water thereby causing the anchor line (16) to rotate the middle portion of the buoy and pay out anchor line. Spin indicators (13) are radially disposed around the circumference of the end portions which cause visible disturbance and splashing of the water surface as the marker buoy rotates on the surface of the water. Although the preferred embodiment comprises four arcuately shaped paddles situate on the circumference of each end portion of the marker buoy, it is to be understood that the shape and number of spin indicators may be altered in other embodiments of the invention.

Engaging means for engaging an external source of rotatory motive power (18) are situated on the longitudinal axis of the marker buoy at the outermost end of each end portion. Although the engaging means is preferably a $\frac{1}{4}''$ square socket of conventional design, suitable for receiving the standard $\frac{1}{4}''$ square adaptor available for many different brands of cordless electric screwdriver, it is to be understood that the engaging means may also comprise slotted, hexagonal, transverse pin, triangular, beveled, or other configurations.

A pair of biasing weights (19) are situated within the end portions and aligned with the longitudinal axis of the marker buoy body. The biasing weights are preferably fabricated from lead or other material having a high specific gravity and are located as near to the circumference of the end portion as is feasible. Adhesives, sockets or other means may be employed to maintain the alignment of the biasing weights with respect to one another. The biasing weights are to be of such a mass that when the marker buoy is placed upon the water surface, the acceleration of gravity on the anchor will cause the anchor to exert a force on the anchor line sufficient to overcome the bias of the eccentrically mounted biasing weights thereby causing the anchor line to rotate the marker buoy on its longitudinal axis and unwind or pay out anchor line from the middle portion of the buoy.

When the anchor reaches the bottom of the body of water, the biasing weights prevent the continued rotation of the marker buoy and thus prevent continued pay out of anchor line thereby causing the marker buoy to retain a location on the surface which is nearly vertical above the location of the anchor on the bottom.

Figure 2:
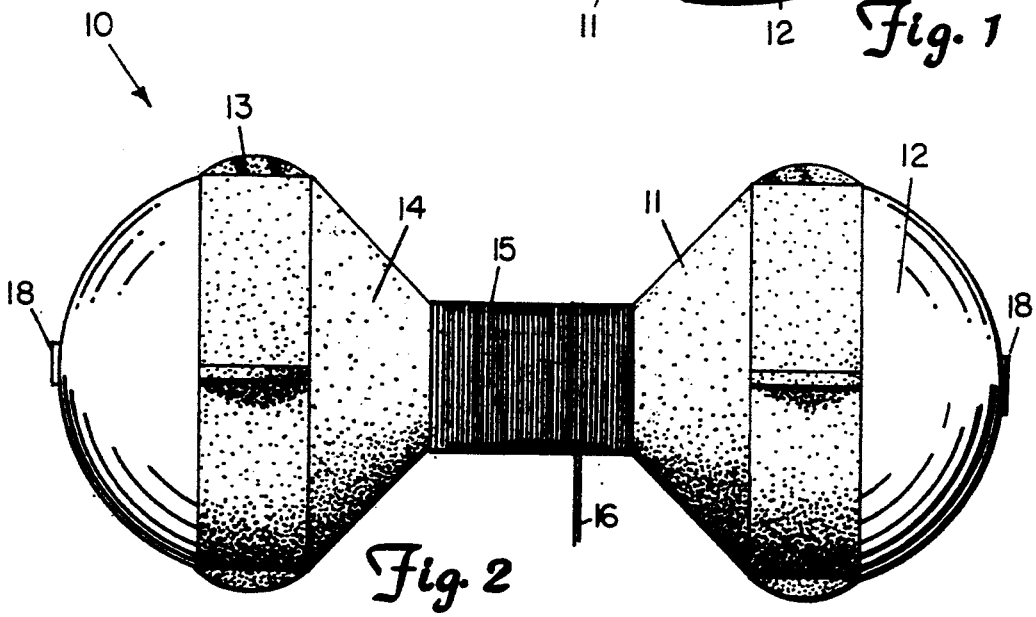
FIG. 2. is a side elevation view of the invention.

FIG. 2 shows a side elevational view of the invention. As may be readily appreciated, the body of the marker buoy can be made of a variety of materials. The preferred method of manufacture is to make the body by the process of injection molding the parts from a plastic such as high-impact polystyrene. Fluorescent and phosphorescent materials including pigments and dyes may be incorporated into the material from which the invention is formed or applied as a coating to the body of the marker buoy. The preferred embodiment is comprised of a substantially hollow body having a solid middle or medial portion and which is sealed to provide buoyancy necessary to cause the marker buoy to float. However, the float body could readily be either polymer foam-filled constructed entirely of polymer foam or constructed of material having sufficiently low specific gravity to provide the requisite operational characteristics. When the invention is constructed of polymer foam or other lightweight materials, reinforcing means may be needed to align the biasing weights and provide adequate mechanical strength and durability.

Figure 3:
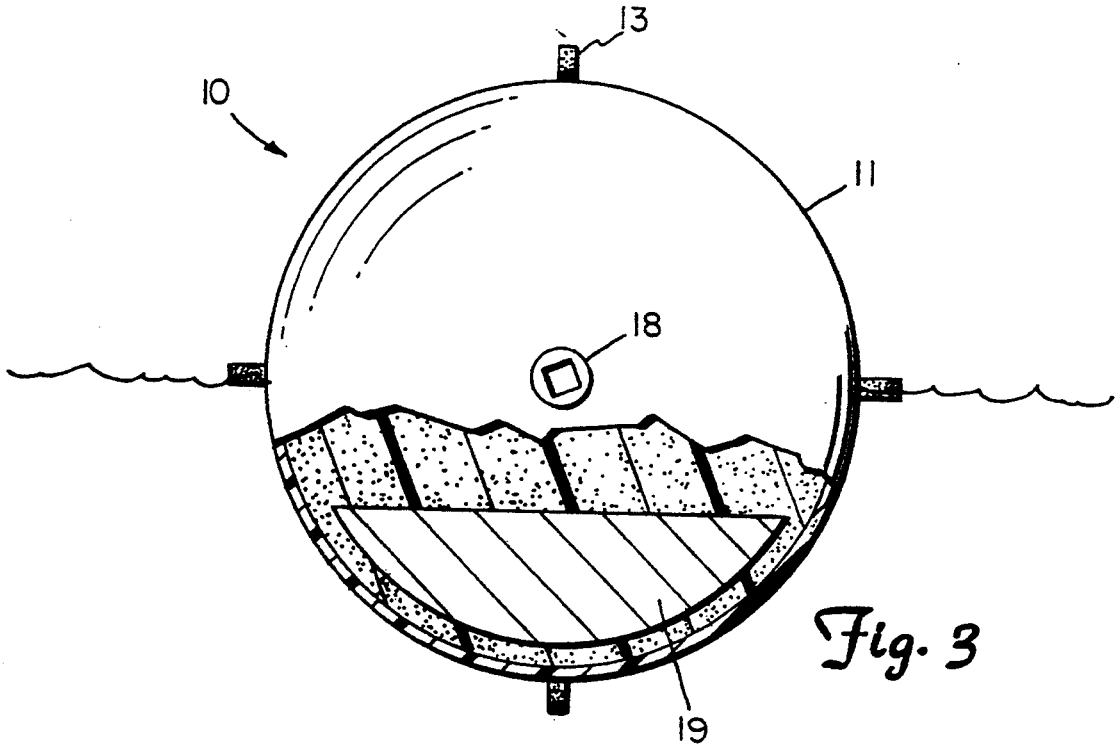
FIG. 3. is an end elevation view of the invention, both ends being identical, showing a cut-away view of the aligned biasing weight situate within each end portion.

FIG. 3 shows the location of the engaging means (18) for engaging an external source of rotatory motive power. A cut-away view is also presented which shows the preferred arrangement of the biasing weights (19). It is to be understood that, although the preferred embodiment utilizes biasing weights to enable the marker buoy to be self-setting, other self-setting methods may be used to achieve equivalent results.

Although particular embodiments of the invention have been illustrated in the accompanying Drawing and described in the preceding Detailed Description, it will be understood that the invention is not limited to the embodiments disclosed, but is intended to embrace any alternatives, modifications, and rearrangements of elements falling within the scope of the invention as defined by the following claims.

What is claimed is:

1. A self-setting marker buoy comprising:

an elongated buoyant body having an elongated reduced medial portion coaxial with the longitudinal axis upon which it may be revolved on top of the water and upon which an anchoring line may be wound;

two buoyant end portions enlarged with respect to the elongated reduced medial portion appended to the two ends of the elongated reduced medial portion forming a pair of spaced buoyant bodies for supporting the entire device;

means for visibly indicating rotation of the buoy about its longitudinal axis;

engaging means for engaging an external source of rotatory motive power capable of causing the body to rotate about its longitudinal axis;

a line having one of its two ends connected to the body;

an anchor weight of high specific gravity secured to the other end of the line and adapted to pay out wound line from the buoy by revolving the buoy when the buoy is loosely thrown upon the water;

the enlarged portions having aligned means for receiving bias weights therein;

a pair of bias weights confined by said means for receiving bias weights and disposed internally of said enlarged buoyant portions, and widely eccentric to the longitudinal axis;

a multiplicity of rounded paddle-shaped protuberances disposed radially about the circumference of the buoyant body for visibly indicating rotation;

fluorescent material comprising a portion of the surface of the buoyant body; and phosphorescent material comprising a portion of the surface of the buoyant body.

2. A marker buoy as defined in claim 1 wherein the engaging means comprises a socket situated along the longitudinal axis of the body.

3. A self-setting marker buoy comprising:

an elongated buoyant body having an elongated reduced medial portion coaxial with the longitudinal axis upon which it may be revolved on top of the water and upon which an anchoring line may be wound;

two buoyant end portions enlarged with respect to the elongated reduced medial portion appended to the two ends of the elongated reduced medial portion forming a pair of spaced buoyant bodies for supporting the entire device;

means for visibly indicating spin of the buoy about its longitudinal axis, said means comprising a protuberance disposed radially about the circumference of the buoyant body;

engaging means for engaging an external source of rotatory motive power capable of causing the body to rotate about its longitudinal axis;

a line having one of its two ends connected to the body;

an anchor weight of high specific gravity secured to the other end of the line and adapted to pay out wound line from the buoy by revolving the buoy when the buoy is loosely thrown upon the water;

the enlarged portions having aligned means for receiving bias weights therein;

a pair of bias weights confined by said means for receiving bias weights and disposed internally of said enlarged buoyant portions, and widely eccentric to the longitudinal axis;

a portion of the surface comprised of fluorescent material;

a portion of the surface comprised of phosphorescent material; and, means for visibly indicating spin comprising a multiplicity of paddle-shaped protuberances disposed radially about the circumference of the buoyant body.

4. A marker buoy as defined in claim 3 wherein the paddle-shaped protuberances are rounded.

5. A marker buoy as defined in claim 4 wherein the engaging means comprises a socket situated along the longitudinal axis of the buoy.

6. A marker buoy as defined in claim 3 wherein the engaging means comprises a socket situated along the longitudinal axis of the buoy.

* * * * *